US005864264A

United States Patent [19]

Hino

[11] Patent Number: 5,864,264

[45] Date of Patent: Jan. 26, 1999

[54] DIELECTRIC FILTER

[75] Inventor: Seigo Hino, Nagoya, Japan

[73] Assignee: NGK Spark Plug Co., Ltd., Nagoya, Japan

[21] Appl. No.: 862,150

[22] Filed: May 22, 1997

[30] Foreign Application Priority Data

May 23, 1996 [JP] Japan ..... 8-153476

[51] Int. Cl.[6] ..... H01P 1/205; H01P 5/12

[52] U.S. Cl. ..... 333/206; 333/134

[58] Field of Search ..... 333/202, 206, 333/207, 126, 134

[56] References Cited

U.S. PATENT DOCUMENTS

| | | | |
|---|---|---|---|
| 4,673,902 | 6/1987 | Takeda et al. | 333/206 X |
| 4,703,291 | 10/1987 | Nishikawa et al. | 333/202 |
| 4,716,391 | 12/1987 | Moutrie et al. | 333/206 |
| 4,896,124 | 1/1990 | Schwent | 333/206 |
| 4,937,542 | 6/1990 | Nakatuka | 333/202 |
| 5,045,824 | 9/1991 | Metroka | 333/206 |
| 5,177,458 | 1/1993 | Newell et al. | 333/206 |
| 5,250,916 | 10/1993 | Zakman | 333/206 |
| 5,327,110 | 7/1994 | Block | 333/222 |
| 5,499,004 | 3/1996 | Noguchi et al. | 333/202 X |

FOREIGN PATENT DOCUMENTS

| | | | |
|---|---|---|---|
| 0 336 255 | 10/1989 | European Pat. Off. . | |
| 0 367 061 | 5/1990 | European Pat. Off. . | |
| 0 442 418 | 8/1991 | European Pat. Off. . | |
| 0 552 761 | 7/1993 | European Pat. Off. . | |
| 63-306701 | 12/1988 | Japan | 333/202 |
| 5-22002 | 1/1993 | Japan | 333/206 |

OTHER PUBLICATIONS

Patent Abstracts of Japan, Pub. No. 04095401, Mar. 27, 1992, Motoharu et al.

*Primary Examiner*—Seungsook Ham
*Attorney, Agent, or Firm*—Larson & Taylor

[57] ABSTRACT

A dielectric filter includes a dielectric ceramic block provided with three or more than three linearly arranged resonators. Coupling through bores are arranged between adjacent ones of the resonators and input/output pads are arranged vis-a-vis the respective outermost resonators for capacitive coupling. There are provided a pair of outer coupling electric paths extending from the respective input/output pads onto the open-circuit end surface which are arranged in juxtaposition with the respective outermost resonators with a coupling gap provided therebetween. A pair of inner coupling electric paths extends from the respective input/output pads onto the open-circuit end surface and are arranged between the outermost resonators in juxtaposition with the inner resonator or the respective inner resonators adjacent to the outermost resonators. A coupling gap is provided therebetween so as to remarkably reduce or eliminate the influence of the fly back x and consequently improve the attenuation performance of the dielectric filter.

16 Claims, 10 Drawing Sheets

DIELECTRIC FILTER

BACKGROUND OF THE INVENTION

1. Field of the Invention

The present invention relates to a dielectric filter comprising a plurality of juxtaposed resonators, and a duplexer using such resonators.

2. Prior Art

FIG. 1 of the accompanying drawings illustrates a known typical dielectric filter comprising a dielectric ceramic block A, three or more than three resonators B provided in the block A respectively by coating the peripheral walls of three or more than three through bores with a conducting material, an external conductor C covering the outer surfaces of the dielectric ceramic block A but not open-circuit end surface having the openings of the through bores, a pair of coupling through bores D arranged between adjacent ones of the resonators B in parallel with the latter and having no coating on the peripheral walls thereof and a pair of input/output pads E arranged on a lateral surface of the dielectric ceramic block A at respective positions abutting the open-circuit end surface of the block A and facing the respective outermost resonators in such a way that they are electrically insulated from the external conductor C. With such arrangement the magnetic field coupling intensity of the adjacent resonators may be intensified because dielectrics are cleared off between adjacent resonators B by a coupling through bore D. A variety of such dielectric filters are currently known.

With such a known arrangement, however, a fly back x (see FIG. 4B) is produced at an attenuation pole in a higher frequency zone of a resonance frequency band under the influence of the coupling through holes D to hold the output level above the threshold value of −50 dB as shown in FIG. 4B and reduce the attenuation w to such an extent that the filter does not operate satisfactorily in terms of attenuation and is apt to generate noise.

It is therefore an object of the present invention to provide a dielectric filter that is free from any degradation in the attenuation effect of the filter due to a fly back x.

Another object of the present invention is to provide a duplexer using such dielectric filter.

SUMMARY OF THE INVENTION

According to one aspect of the invention, there is provided a dielectric filter comprising a dielectric ceramic block, three or more than three resonators provided in said dielectric ceramic block respectively, each resonator including a through bore and an inner conductor on a peripheral wall of the through bore, an external conductor covering the outer surfaces of the dielectric ceramic block excepting an open-circuit end surface having openings of the through bores, coupling through bores arranged between adjacent ones of said resonators in parallel with the latter and a pair of input/output pads arranged on a lateral surface of said dielectric ceramic block at respective positions abutting the open-circuit end surface of the block and facing the respective outermost resonators in such a way that they are electrically insulated from the external conductor, wherein the filter comprises outer coupling electric paths extending from said respective input/output pads onto the open-circuit end surface and arranged in juxtaposition with the respective outermost resonators with a coupling gap provided therebetween and inner coupling electric paths extending from the respective input/output pads onto the open-circuit end surface and arranged between the outermost resonators in juxtaposition with the inner resonator or the respective inner resonators adjacent to the outermost resonators with a coupling gap provided therebetween.

The dielectric filter further may comprise a rectangularly extended conductor arranged on the open-circuit end surface of the dielectric ceramic block to surround the internal conductor of the inner resonator or each of the respective inner resonators and connected to the internal conductor of said inner resonator or each of the respective inner resonators.

Preferably, the free end of each of said inner coupling electric paths may be arranged to be adjacent to the respective rectangularly extended conductor on the open-circuit end surface of the dielectric ceramic block.

Also, the free end of each of the outer coupling electric paths may be provided with an arcuate coupling tip to surround the opening of the associated through bore with the coupling gap therebetween.

Futhermore, rectangularly extended conductors may be arranged on the open-circuit end surface of the dielectric ceramic block to surround the internal conductors of the respective outermost resonators and connected to the internal conductors of the respective outermost resonators.

Preferably, the input/output pads may be disposed on an outer surface portion of the dielectric ceramic block to be brought into contact with a printed circuit board when the filter is mounted on the circuit board.

Alternatively, the input/output pads may be disposed on other outer surface portion than that to be brought into contact with a printed circuit board when the filter is mounted on the circuit board.

Each of said rectangularly extended conductors arranged to surround the internal conductors of the respective outermost resonators and connected thereto may be provided with at least one notch, and each of the outer coupling electric paths may be provided with a corresponding coupling projection which is engaged with the notch.

With such an arrangement, it has been proved that the input/output pads are capacitively coupled with the inner resonator or the respective resonators by means of the inner coupling electric paths to effectively reduce or eliminate the influence of the above described fly back x.

According to another aspect of the invention, there is provided a dielectric filter for a duplexer having a transmitter section and a receiver section provided on a dielectric ceramic block, said transmitter section having three or more than three resonators juxtaposed to each other in the dielectric ceramic block, each of which includes a through bore and an inner conductor provided on inner peripheral wall of the through bore, said dielectric ceramic block being provided with an external conductor covering an outer surface excepting an open-circuit end surface thereof, coupling through bores arranged between adjacent ones of the resonators in parallel with the latter and a pair of input/output pads arranged on a lateral surface of said dielectric ceramic block at respective positions abutting the open-circuit end surface of the block and facing the respective outermost resonators in such a way that they are electrically insulated from the external conductor, wherein said transmitter section comprises outer coupling electric paths extending from said respective input/output pads onto the open-circuit end surface and arranged in juxtaposition with the respective outermost and innermost resonators with a coupling gap provided therebetween and inner coupling electric paths extending from the respective input/output pads onto the open-circuit end surface and arranged between the outermost and innermost resonators in juxtaposition with the inner resonator or the respective inner resonators adjacent to the outermost and innermost resonators with a coupling gap provided therebetween.

The receiver section comprises a plurality of resonators provided in a row, one of the input/output pads is associated with the innermost resonators of the transmitter and receiver sections and is arranged to be operated as an input pad for the receiver section, and an output pad is capacitively coupled to the outermost resonator of the receiver section.

With this arrangement again, the influence of the fly back x will be effectively reduced or eliminated.

DETAILED DESCRIPTION OF THE INVENTION

Now the present invention will be described by referring to the accompanying drawings that illustrate preferred embodiments of the invention. The components that are same or similar throughout the embodiments will be denoted respectively by same reference symbols and will be described without redundancy.

Figure 1:
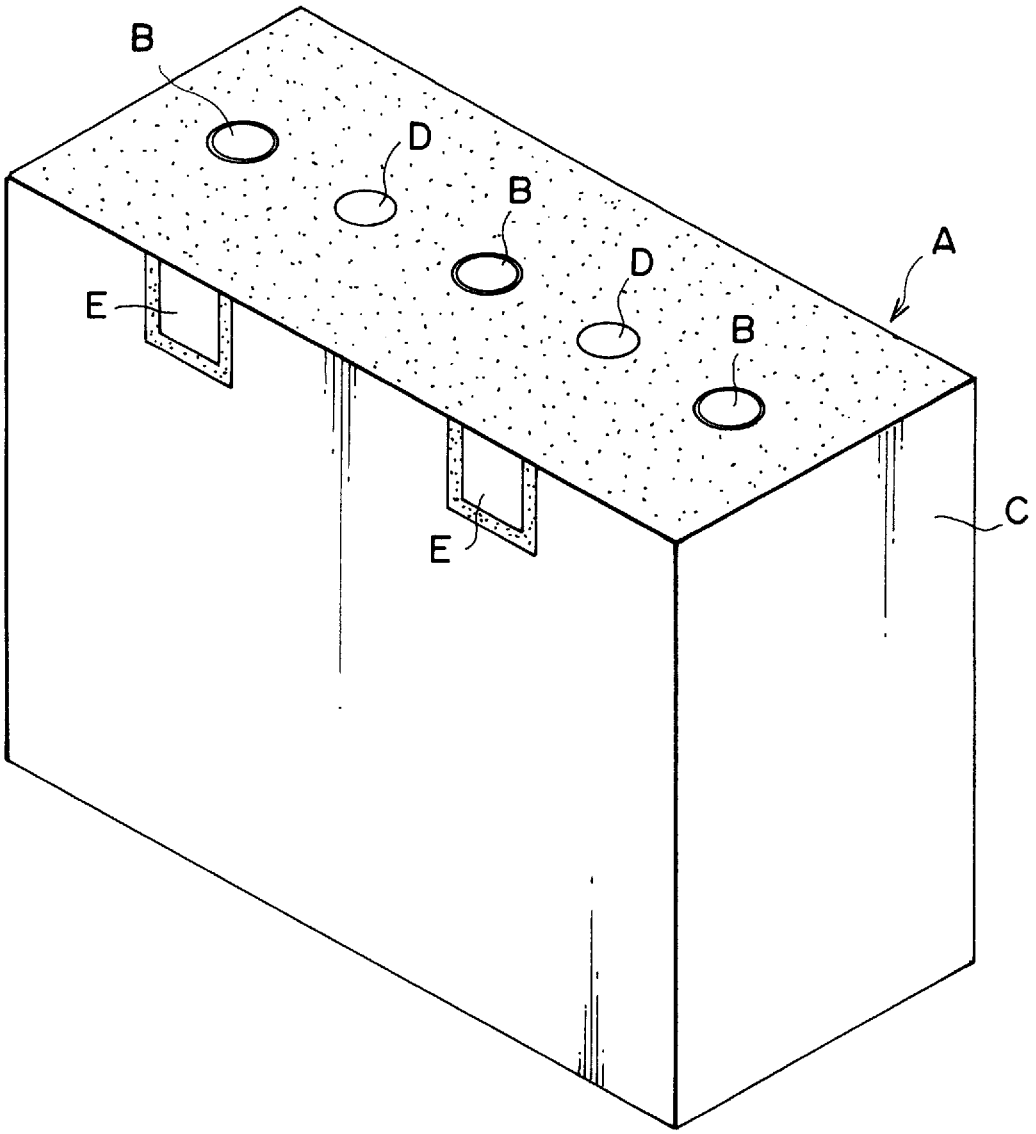
FIG. 1 PRIOR ART
FIG. 1 is a schematic perspective view of a comparable known dielectric filter.
Figure 2:
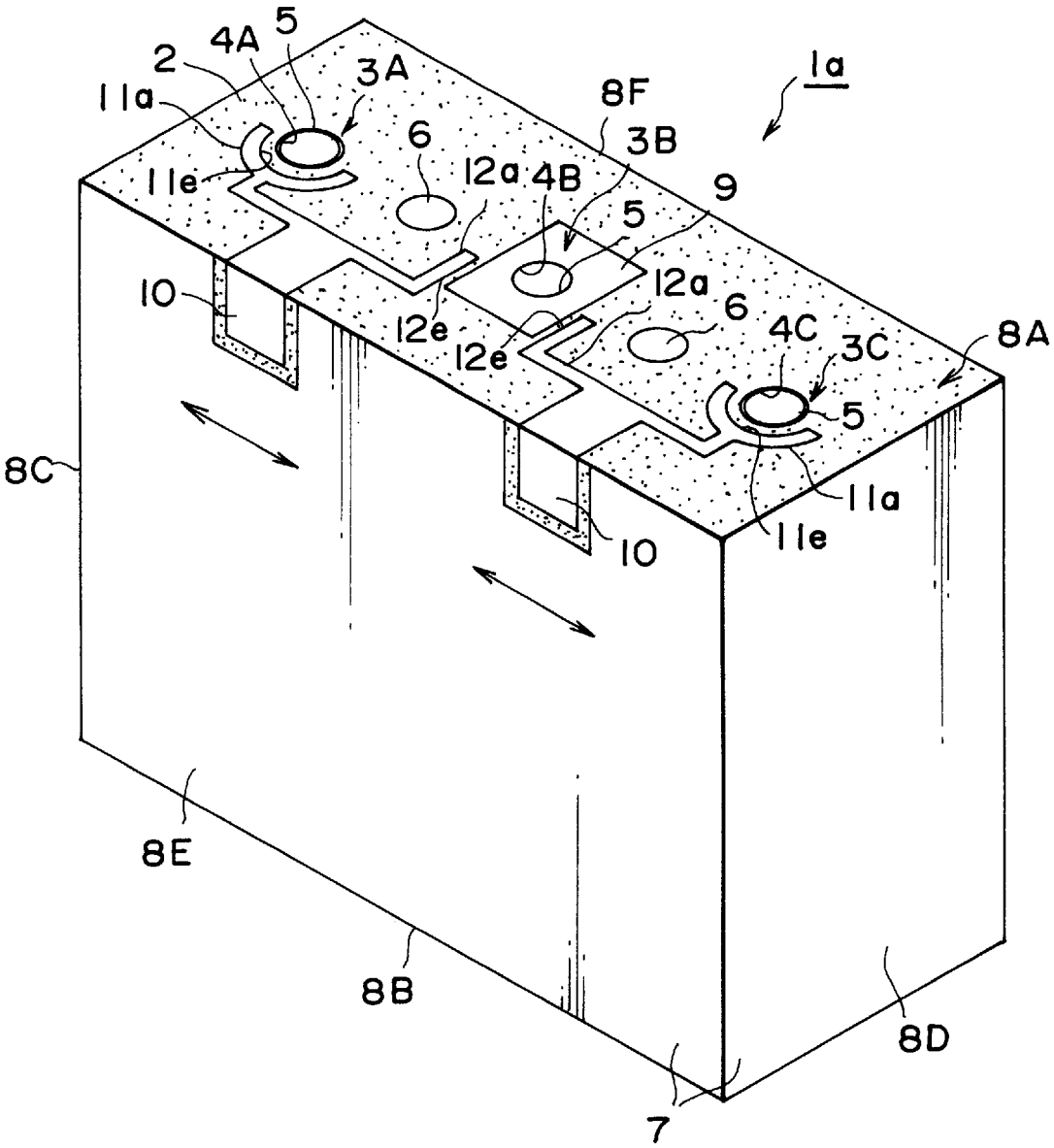
FIG. 2 is a schematic perspective view of a first embodiment of a dielectric filter according to the invention.
Figure 3:
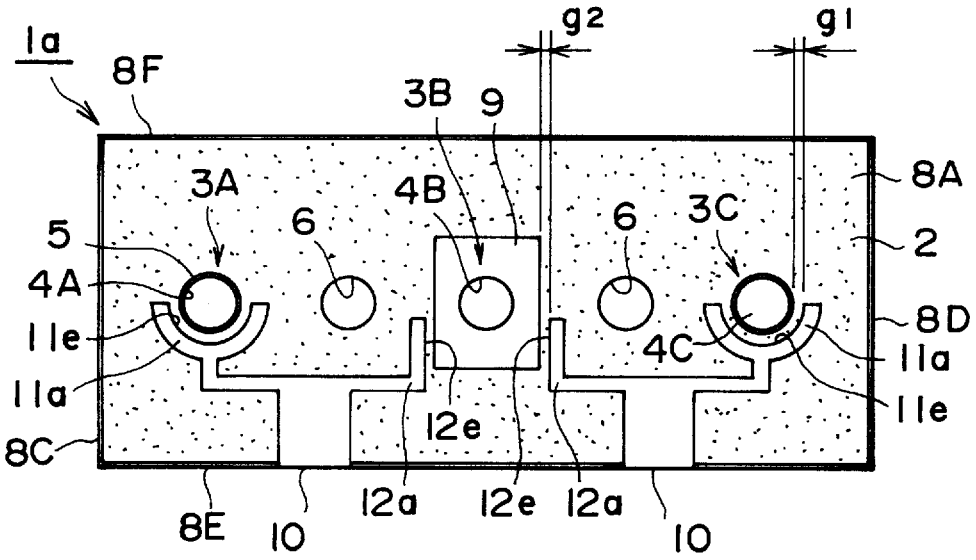
FIG. 3 is a schematic plan view of the dielectric filter of FIG. 2.

FIGS. 2 and 3 shows a first embodiment of dielectric filter la according to the invention, which is a three pole type dielectric filter having three resonators.

The illustrated dielectric filter la comprises a substantially rectangularly parallelepipedic dielectric ceramic block 2 made of a titanium oxide type material and provided with three resonators 3A, 3B and 3C that are arranged in parallel with each other. The resonators 3A, 3B and 3C are realized by forming through bores 4A, 4B and 4C running through the dielectric ceramic block 2 and coating the peripheral inner walls of the through bores 4A, 4B and 4C with a conductive material to produce internal conductors 5.

A pair of coupling through bores 6 are arranged respectively between the resonators 3A and 3B and between the resonators 3B and 3C and in parallel with the through bores 4A, 4B and 4C to couple the adjacent resonators. No internal conductor is arranged on the coupling through bores 6 and 6. The coupling intensity of the adjacently located resonators 3A and 3B and that of the resonators 3B and 3C are boosted by the respective coupling through bores 6 and 6.

An external conductor 7 is formed by covering the outer surfaces 8B–8F of the dielectric ceramic block 2 also with a conductive material but not an open-circuit end surface 8A having the openings of the through bores 4A, 4B and 4C. The external conductor 7 operates as a shield or ground electrode. Note that the resonators 3A, 3B and 3C have a resonance length substantially equal to a quarter of the resonance frequency $\lambda$ or $\lambda/4$.

A rectangularly extended conductor 9 is arranged on the open-circuit end surface 8A of dielectric ceramic block 2, surrounding the open end of the resonator 3B, and connected to the internal conductor 5 thereof on the peripheral wall of the through bore 4B.

The principal components of the illustrated dielectric filter according to the invention will now be described.

A pair of input/output pads 10 are arranged on a lateral surface 8E (which is to be directly mounted on a printed circuit board not shown) of the dielectric ceramic block 2 vis-a-vis the respective outermost resonators 3A and 3C for capacitive coupling and insulated from the external conductor 7. Therefore, the input/output pads 10 are to be electrically connected to conductors arranged, for example, on the printed circuit board.

On the open-circuit end surface 8A of dielectric ceramic block 2 are provided outer coupling electric paths 11*a* which are respectively extending from the input/output pads 10 onto the open-circuit end surface 8A and arranged in juxtaposition with the respective openings of the outermost resonators 3A and 3C with a coupling gap provided therebetween. On the open-circuit end surface 8A of dielectric ceramic block 2 are also provided inner coupling electric paths 12*a* which are respectively extending from the respective input/output pads 10 onto the open-circuit end surface 8A and arranged between the outermost resonators 3A and 3C in the areas adjacent to the conductor 9 on the inner resonator 3B with a coupling gap provided therebetween.

The free ends of the outer coupling electric paths 11*a* are provided with respective arcuate coupling tips 11*e* to surround the respective openings of the through bores 4A and 4C with a coupling gap g1 disposed therebetween. The inner coupling electric paths 12*a* are L-shaped and provided with respective straight coupling tips 12*e* separated from the conductor 9 by a coupling gap g2.

The input/output pads 10 are capacitively coupled to the respective resonators 3A and 3C by way of the respective outer coupling electric paths 11*a* and also to the resonator 3B by way of the respective inner coupling electric paths 12*a*.

Figure 4A:
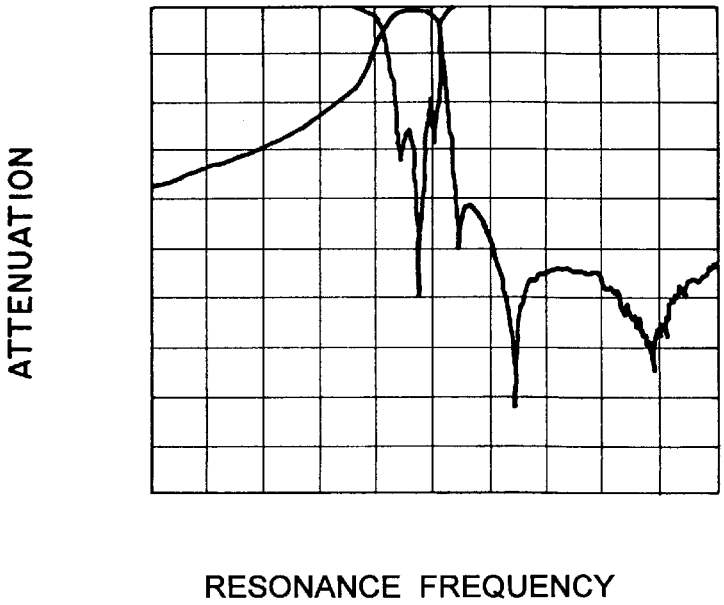
FIG. 4A is a graph showing an attenuation waveform of the dielectric filter shown in FIGS. 2 and 3.
Figure 4B:
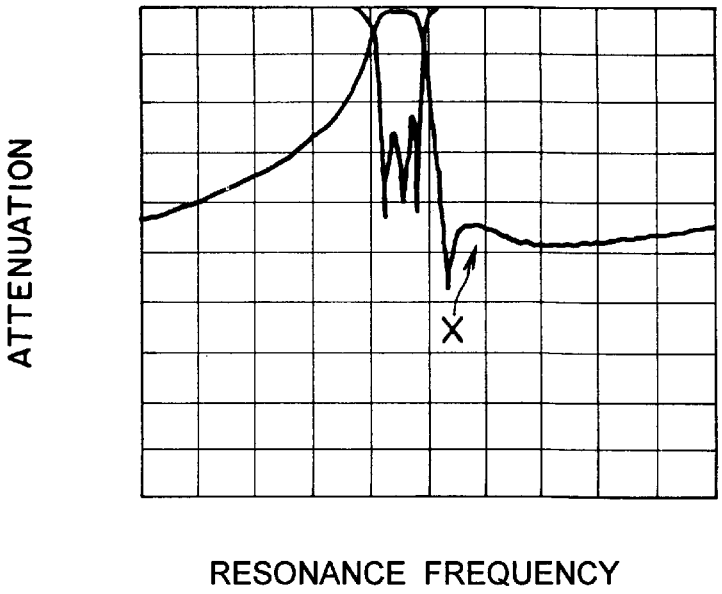
FIG. 4B PRIOR ART
FIG. 4B is a graph showing the attenuation waveform of the comparable dielectric filter shown in FIG. 1 which is equivalent to one obtained by using the dielectric filter illustrated in FIGS. 2 and 3 from which internal coupling electric paths are removed as will be described hereinafter.

FIG. 4A shows the attenuation waveform of the illustrated dielectric filter. FIG. 4B shows the attenuation waveform of a comparable dielectric filter realized with no inner coupling electric paths. By comparing the two graphs, it will be appreciated that the waveform of FIG. 4B has a fly back x produced in a higher frequency zone of the resonance frequency band under the influence of the coupling through bores 6 to hold the output level above the threshold value of −50 dB. Contrary to this, the fly back x is reduced to less than −50 dB in this illustrated embodiment to make the filter perform remarkably in terms of attenuation.

Figure 5:
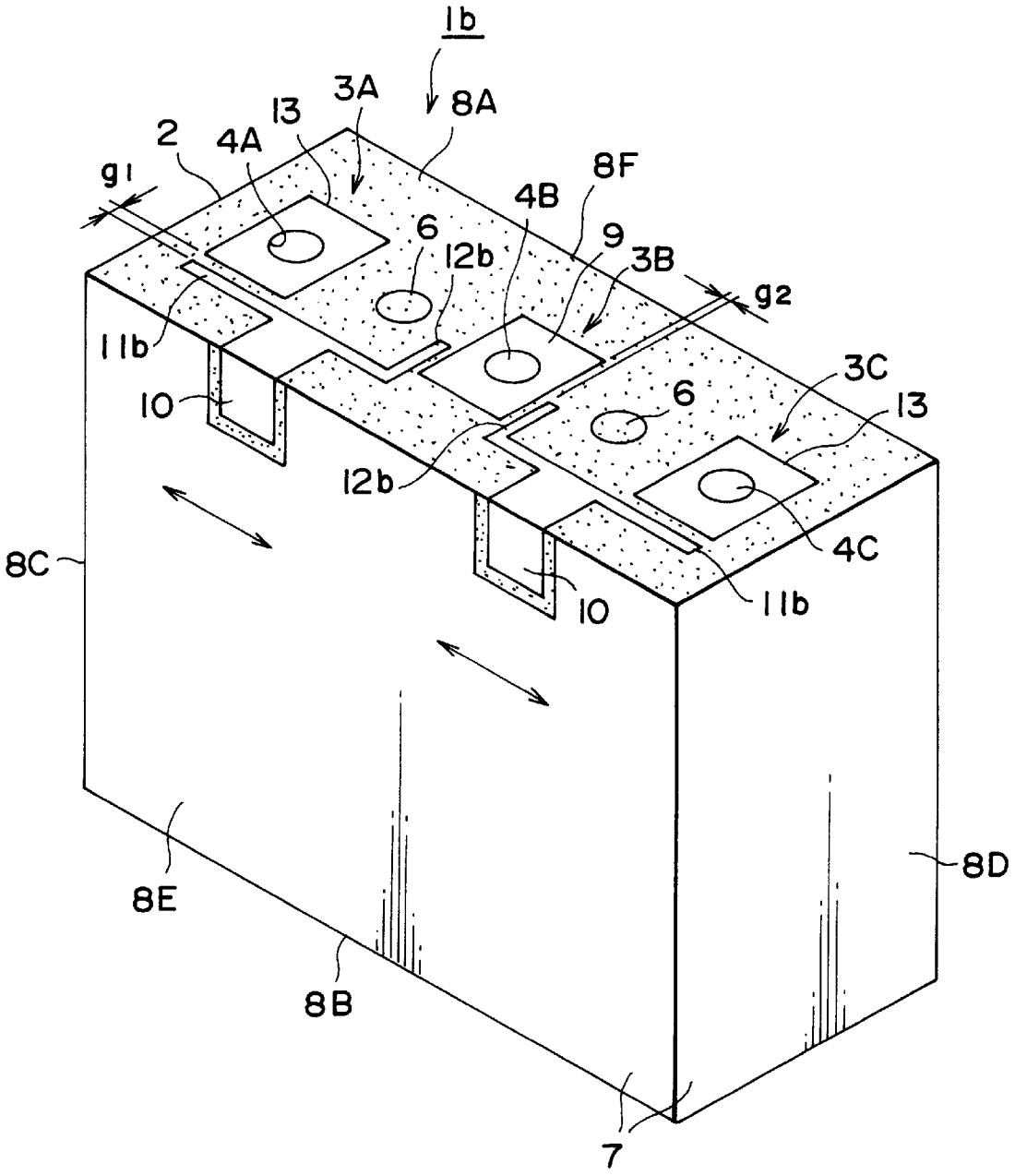
FIG. 5 is a schematic perspective view of a second embodiment of a dielectric filter according to the invention.

FIG. 5 illustrates a second embodiment of dielectric filter 1*b* according to the invention having outer coupling electric paths 11*b* having a profile different from that of their counterparts of the first embodiment illustrated in FIGS. 2 and 3. In this second embodiment, rectangularly extended conductors 13 are arranged on the open-circuit end surface 8A of dielectric ceramic block 2, surrounding the respective open ends of the resonators 3A and 3C, and connected to the internal conductors 5 thereof on the peripheral walls of the through bores 4A and 4C. Thus, the outer coupling electric paths 11*b* are linearly formed and arranged in juxtaposition with the respective front edges of the rectangular conductors 13 with a coupling gap g1 provided therebetween. Meanwhile, inner coupling electric paths 12*b* similar to their counter-parts of the first embodiment are extending from the respective input/output pads 10 and arranged in juxtaposition with the respective lateral edges of the rectangular conductor 9 of the resonator 3B with a coupling gap g2 provided therebetween.

In each of the above embodiments, the input/output pads 10 are capacitively coupled to the respective resonators 3A and 3C by way of the respective outer coupling electric paths 11*a* and 11*b* and also to the resonator 3B by way of the respective inner coupling electric paths 12*a* and 12*b*. Unlike known dielectric filters where the input/output pads are juxtaposed along a lateral side of the dielectric block and capacitively coupled to the respective resonators by way of dielectrics, the input/output pads 10 of each of the above embodiments can be displaced appropriately in the direction of the arrows in FIGS. 2 and 5 along the lateral surface 8E of the dielectric ceramic block 2 to respective positions corresponding to the related conductors on a printed circuit board so long as the electric connections between the pads and the outer coupling electric paths and between the pads and the respective inner coupling electric paths remain.

Figure 6:
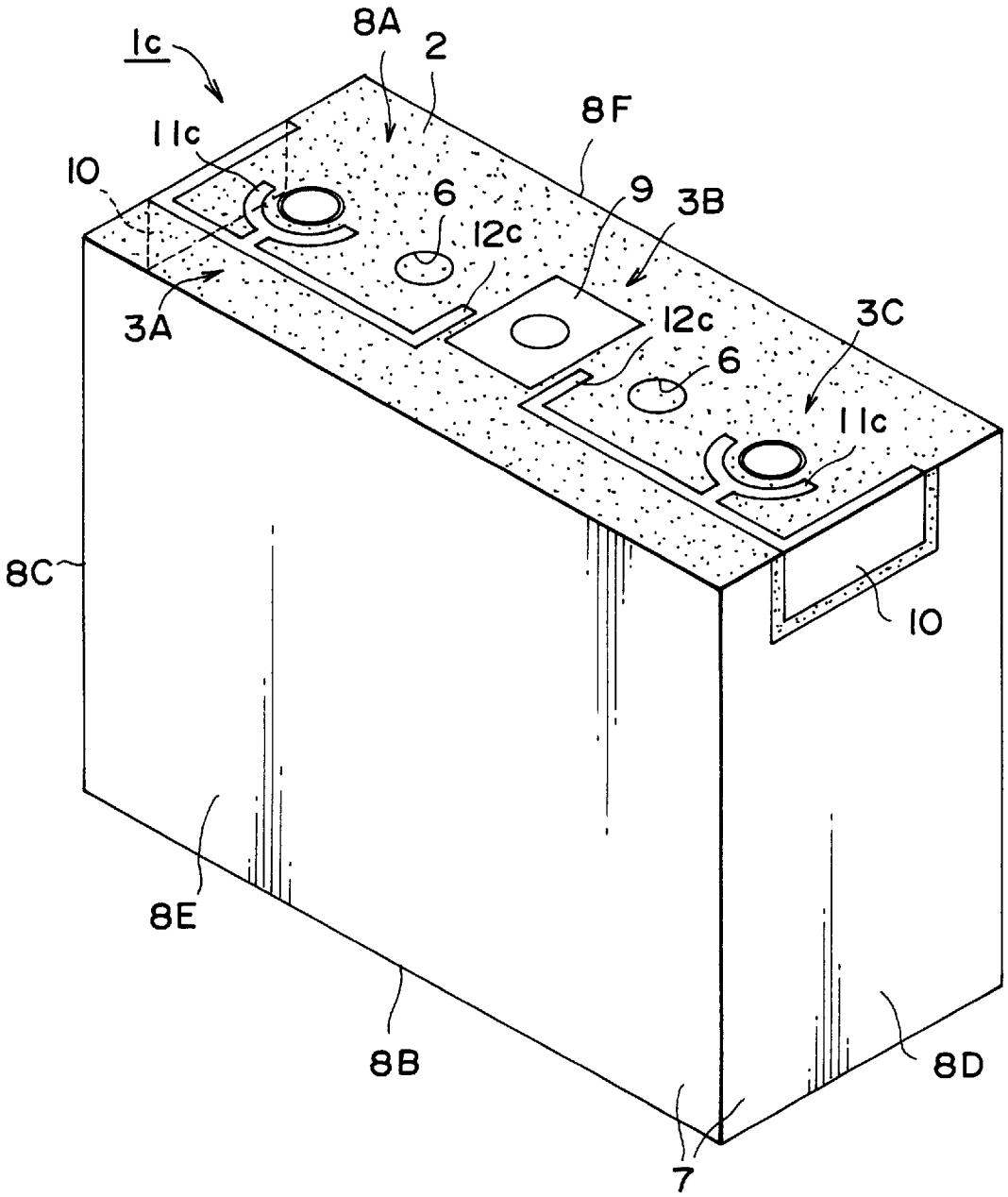
FIG. 6 is a schematic perspective view of a third embodiment of a dielectric filter according to the invention.

FIG. 6 illustrates a third embodiment of dielectric filter 1*c* according to the invention, where the input/output pads 10 are arranged respectively on oppositely disposed lateral surfaces 8C and 8D of the dielectric ceramic block 2. With this arrangement, the input/output pads 10 may be exposed on the printed circuit board on which the dielectric filter is arranged so that the related leads may be arranged easily to connect the dielectric filter and the printed circuit board by way of the input/output pads 10. In this embodiment again, outer coupling electric paths 11*c* and inner coupling electric paths 12*c* are extending respectively from the input/output pads 10 and juxtaposed with the respective resonators 3A, 3B and 3C with coupling gaps g1 and g2 provided therebetween for capacitive coupling in a manner as described above by referring to the first and second embodiments.

As will be understood from the above description, a variety of different profiles and arrangements may be conceivable for the outer and inner coupling electric paths corresponding to the positions of the input/output pads 10 and the contours of the conductors 9 and 13.

Figure 7:
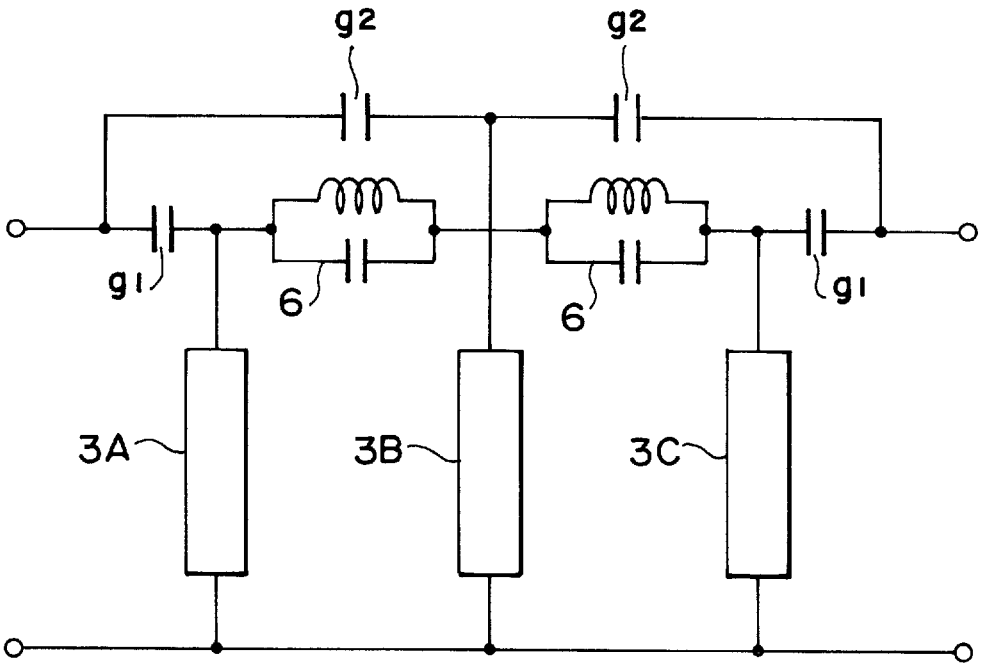
FIG. 7 is a circuit diagram of an equivalent circuit of the dielectric filter according to the invention.

FIG. 7 shows a circuit diagram of an equivalent circuit of the illustrated filter 1*a*.

Figure 8:
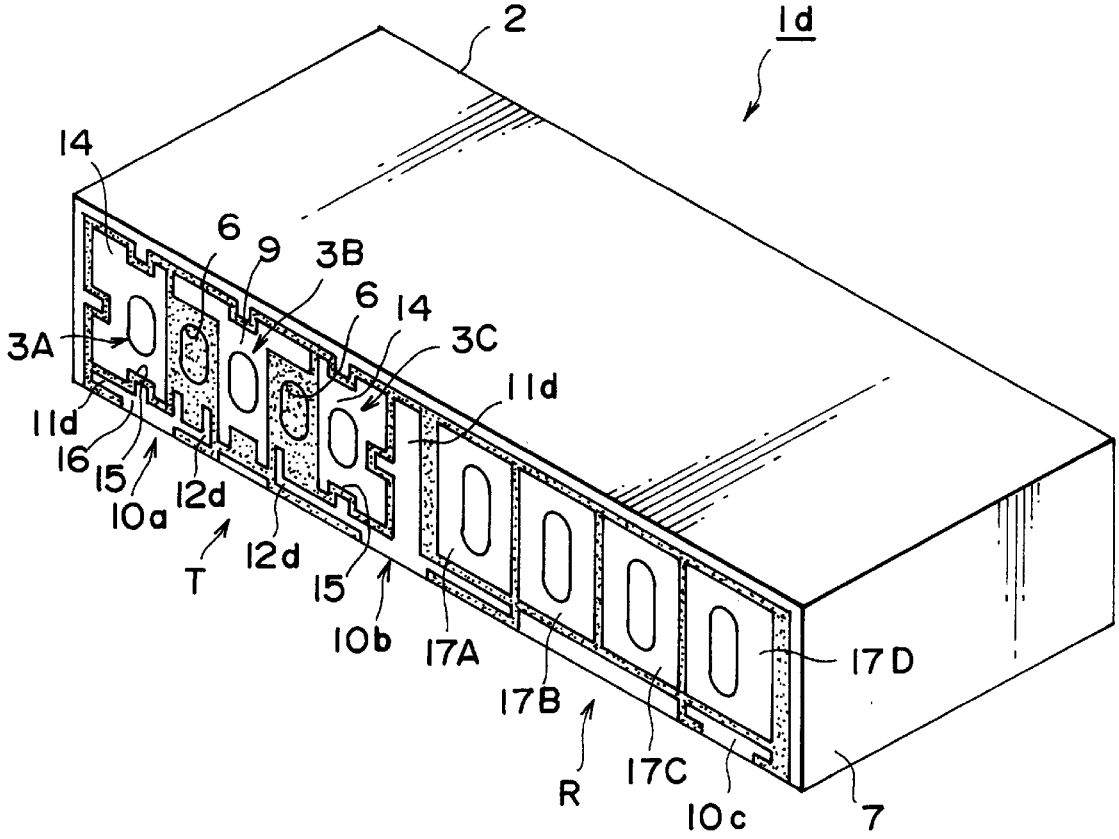
FIG. 8 is a schematic perspective view of a fourth embodiment of a dielectric filter according to the invention to be used as a duplexer.
Figure 9:
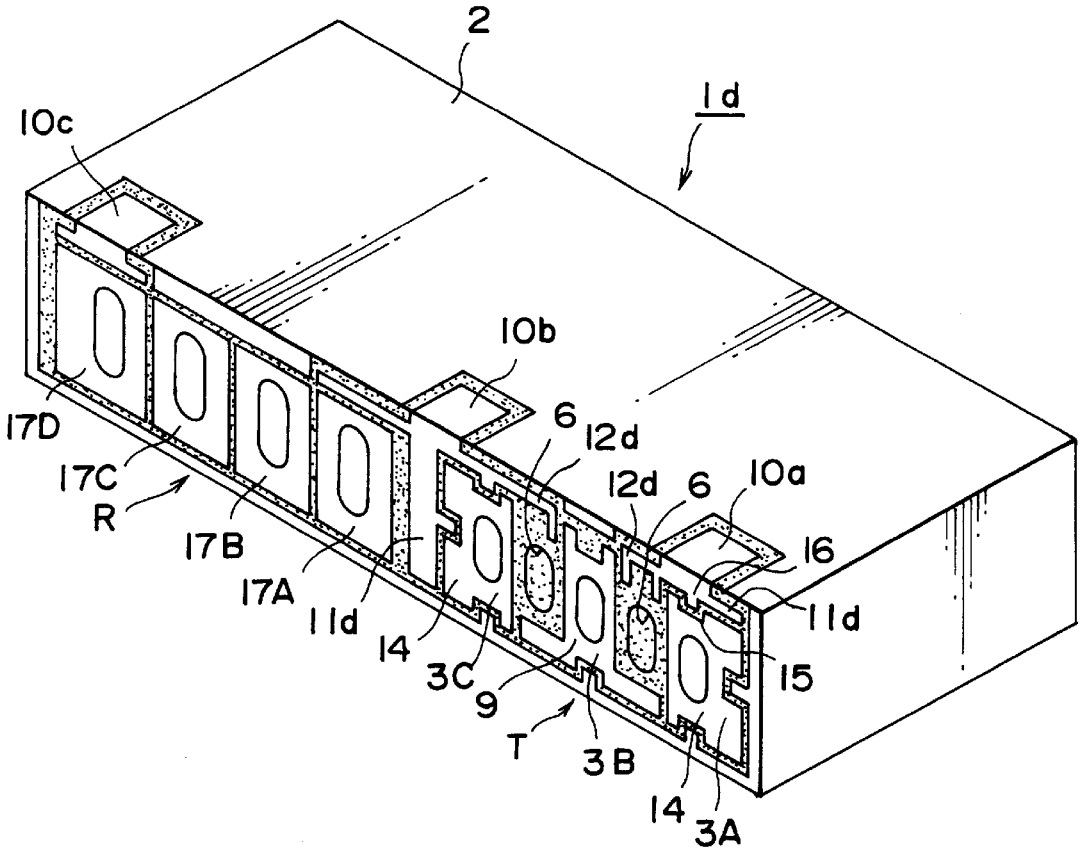
FIG. 9 is another schematic perspective view of the fourth embodiment of dielectric filter placed upside down relative to FIG. 8.

FIGS. 8 and 9 schematically illustrate a fourth embodiment of dielectric filter 1*d* according to the invention which is to be used as a duplexer comprising a transmitter section T and a receiver section R.

In this embodiment, the transmitter section T includes a pair of input/output pads 10*a* and 10*b*, outer and inner coupling electric paths 11*d* and 12*d* extending respectively from the input/output pads 10*a* and 10*b* and arranged respectively in juxtaposition with the substantially rectangular conductors 9 and 14 of resonators 3A, 3B and 3C for capacitive coupling in a manner as described earlier.

In this embodiment, the rectangular conductors 14 of the outermost resonators 3A and 3C may be provided with notches 15 and the outer coupling electric paths 11*d* may be provided with corresponding coupling projections 16 projecting into the respective notches 15, whereas the inner coupling electric paths 12*d* have a L-shaped profile as in the case of the preceding embodiments. Note that, in this embodiment, the outer input/output pad 10*a* actually operates as an input pad whereas the inner input/output pad 10*b* operates as an output pad.

The receiver section R of this embodiment has a four-poled structure in which four resonators 17A, 17B, 17C and 17D are provided in a row. An output pad 10*c* is capacitively coupled to the outermost resonator 17D of the receiver section R whereas the inner input/output pad 10*b* of the transmitter section T is shared by the receiver section R and operating as an input pad of the latter.

With the embodiment illustrated in FIGS. 8 and 9, alternatively the rectangular conductors 14 of the outermost resonators 3A and 3C may be formed without any notches as in the arrangement of the second embodiment illustrated in FIG. 5.

Figure 10A:
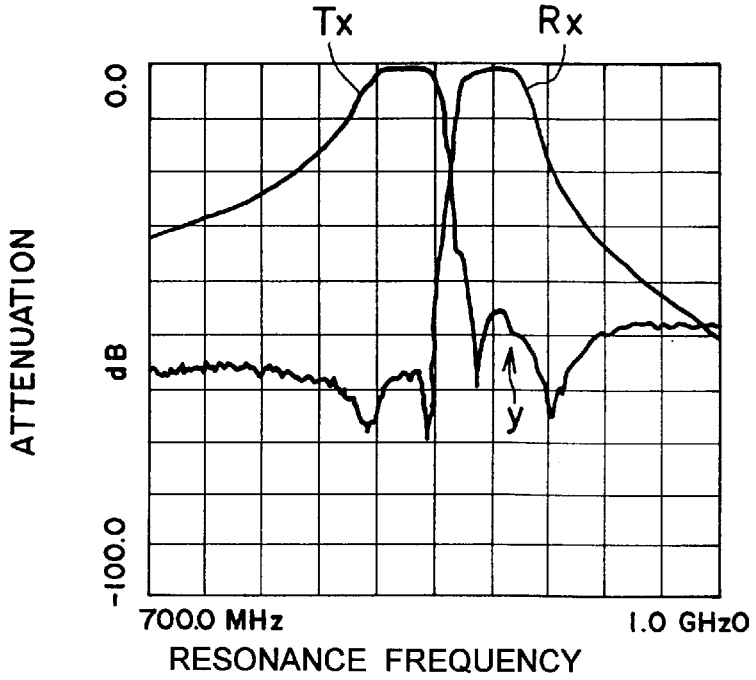
FIG. 10A is a graph showing the attenuation waveform of the dielectric filter illustrated in FIGS. 8 and 9.
Figure 10B:
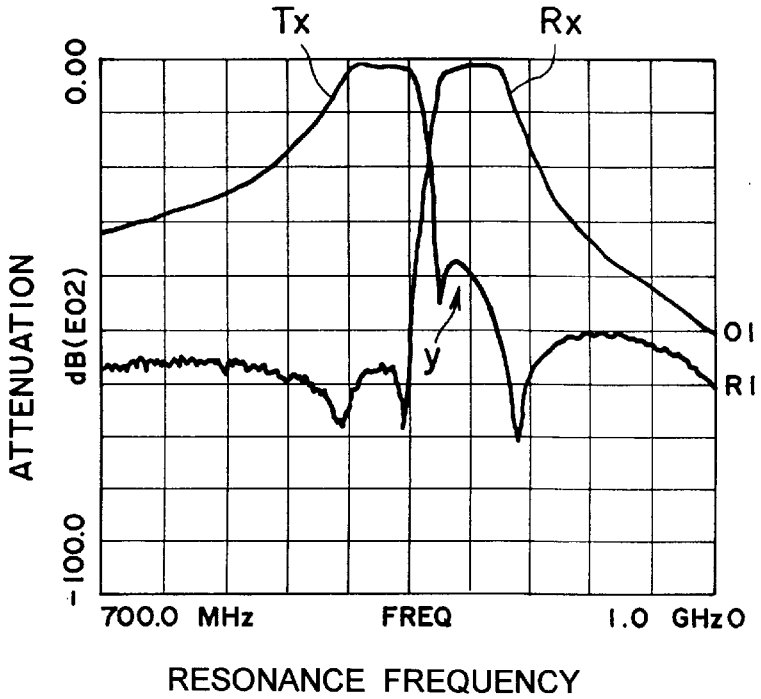
FIG. 10B is a graph showing the attenuation waveform of a comparable dielectric filter.

FIG. 10A shows the waveform of the transmission wave Tx and that of the reception wave Rx of dielectric filter 1*d* in the fourth embodiment. FIG. 10B a comparable graph obtained by a dielectric filter realized by removing only the inner coupling electric paths 12*d* and 12*d* from the fourth embodiment. By comparing the two graphs, it will be appreciated that the fly back y is remarkably suppressed in the transmission wave Tx of FIG. 10A.

With the respective embodiments, the resonators 3A, 3B and 3C are realized by using through bores having a circular cross section, the through bores may be replaced by through holes having a square, oval or rectangular cross section. Thus, resonators having a variety of different cross sectional views may be conceivable.

Thus, in the dielectric filter according to the invention, with the provision of the outer coupling electric paths extending from the respective input/output pads onto the open-circuit end surface of the dielectric ceramic block and arranged in juxtaposition with the respective outermost resonators with a coupling gap provided therebetween and the provision of the inner coupling electric paths also extending from the respective input/output pads onto the open-circuit end surface of the dielectric ceramic block and arranged between the outermost resonators in juxtaposition with the inner resonator or the respective inner resonators adjacent to the outermost resonators with a coupling gap provided therebetween, the input/output pads and the inner resonator or resonators are capacitively coupled with the respective input/output pads to remarkably reduce or eliminate the influence of the fly back x or y and consequently improve the attenuation performance of the dielectric filter and reduce the generation of noise.

I claim:

1. A dielectric filter comprising a dielectric ceramic block; at least three resonators provided in said dielectric ceramic block respectively, each resonator including a through bore and an inner conductor on a peripheral wall of the through bore; an external conductor covering the outer surfaces of said dielectric ceramic block except for an open-circuit end surface having openings of the through bores; coupling through bores arranged between adjacent ones of said resonators in parallel with said resonators; a pair of input/output pads arranged on a lateral surface of said dielectric ceramic block at respective positions abutting the open-circuit end surface of the block and facing the respective outermost resonators in such a way that they are electrically insulated from said external conductor; outer coupling electric paths extending from said respective input/output pads onto the open-circuit end surface and arranged in juxtaposition with the respective outermost resonators with a coupling gap provided between said outer electric coupling paths and the respective outermost resonators; and inner coupling electric paths extending from the respective input/output pads onto the open-circuit end surface and arranged between the outermost resonators in juxtaposition with the inner resonator or the respective inner resonators adjacent to the outermost resonators with a coupling gap provided between said inner electric coupling paths and the inner resonator or the respective inner resonators wherein said outer electric coupling paths and said inner electric coupling paths are configured to suppress the influence of a fly back.

2. A dielectric filter as claimed in claim 1, further comprising a rectangularly extended conductor arranged on the open-circuit end surface of said dielectric ceramic block to surround the inner conductor of said inner resonator or each of said respective inner resonators and connected to the inner conductor of said inner resonator or each of said respective inner resonators.

3. A dielectric filter as claimed in claim 2, wherein each of said inner coupling electric paths has a free end arranged to be adjacent to said respective rectangularly extended conductor on the open-circuit end surface of said dielectric ceramic block.

4. A dielectric filter as claimed in claim 1, wherein each of said outer coupling electric paths has a free end provided with an arcuate coupling tip to surround the opening of the associated resonator through bore with the coupling gap therebetween.

5. A dielectric filter as claimed in claim 1, further comprising rectangularly extended conductors arranged on the open-circuit end surface of said dielectric ceramic block to surround the inner conductors of said respective outermost resonators and connected to the inner conductors of said respective outermost resonators.

6. A dielectric filter as claimed in claim 1, wherein the lateral surface of said dielectric ceramic block where said input/output pads are disposed is an outer surface portion to be brought into contact with a printed circuit board when the filter is mounted on the circuit board.

7. A dielectric filter as claimed in claim 1, wherein said input/output pads are provided on other outer surface portion than that to be brought into contact with a printed circuit board when the filter is mounted on the circuit board.

8. A dielectric filter as claimed in claim 1, wherein each of said rectangularly extended conductors arranged to surround the inner conductors of said respective outermost resonators and connected thereto is provided with at least one notch, and each of said outer coupling electric paths is provided with a corresponding coupling projection which is engaged with said notch.

9. A dielectric filter for a duplexer having a transmitter section and a receiver section provided on a dielectric ceramic block, wherein said transmitter section comprises at least three resonators juxtaposed to each other in the dielectric ceramic block, each of which includes a through bore and an inner conductor provided on an inner peripheral wall of the through bore, said dielectric ceramic block being provided with an external conductor covering an outer surface except for an open-circuit end surface thereof; coupling through bores arranged between adjacent ones of the resonators in parallel with said resonators; a pair of input/output pads arranged on a lateral surface of said dielectric ceramic block at respective positions abutting the open-circuit end surface of the block and facing the respective outermost resonators of said transmitter section with a coupling gap provided between said outer electric coupling paths and the respective outermost resonators; and inner coupling electric paths extending from the respective input/output pads onto the open-circuit end surface and arranged between the outermost resonators in juxtaposition with the inner resonator or the respective inner resonators adjacent to the outermost resonators of said transmitter section with a coupling gap provided between said inner electric coupling paths and the inner resonator or the respective inner resonators wherein said outer electric coupling paths and said inner electric coupling paths are configured to suppress the influence of a fly back.

10. A dielectric filter as claimed in claim 9, further comprising a rectangularly extended conductor arranged on the open-circuit end surface of said dielectric ceramic block to surround the inner conductor of said inner resonator or each of said respective inner resonators and connected to the inner conductor of said inner resonator or each of said respective inner resonators disposed between the outermost resonators of the transmitter section.

11. A dielectric filter as claimed in claim 10, wherein each of said inner coupling electric paths has a free end arranged to be adjacent to said respective rectangularly extended conductor on the open-circuit end surface of said dielectric ceramic block.

12. A dielectric filter as claimed in claim 9, wherein each of said outer coupling electric paths has a free end provided with an arcuate coupling tip to surround the opening of the associated resonator through bore with the coupling gap therebetween.

13. A dielectric filter as claimed in claim 9, further comprising rectangularly extended conductors arranged on the open-circuit end surface of said dielectric ceramic block to surround the inner conductors of said respective outermost resonators and connected to the inner conductors of said respective outermost resonators.

14. A dielectric filter as claimed in claim 9, wherein the lateral surface of said dielectric ceramic block where said input/output pads are disposed is an outer surface portion to be brought into contact with a printed circuit board when the filter is mounted on the circuit board.

15. A dielectric filter as claimed in claim 9, wherein each of said rectangularly extended conductors arranged to surround the inner conductors of said respective outermost resonators and connected thereto is provided with at least one notch, and each of said outer coupling electric paths is provided with a corresponding coupling projection which is engaged with said notch.

16. A dielectric filter as claimed in claim 9, wherein said receiver section comprises a plurality of resonators provided in a row, one of said input/output pads is associated with the innermost resonators of said transmitter and receiver sections and is arranged to be operated as an input pad for said receiver section, and an output pad is capacitively coupled to the outermost resonator of said receiver section.

* * * * *